US010543973B2

(12) United States Patent
Cunningham

(10) Patent No.: US 10,543,973 B2
(45) Date of Patent: Jan. 28, 2020

(54) SYSTEM AND METHOD FOR MAINTAINING A TEMPERATURE WITHIN A COOLER

(76) Inventor: Brent Eugene Cunningham, Lockhart, TX (US)

( * ) Notice: Subject to any disclaimer, the term of this patent is extended or adjusted under 35 U.S.C. 154(b) by 0 days.

(21) Appl. No.: 13/368,494

(22) Filed: Feb. 8, 2012

(65) Prior Publication Data

US 2013/0200083 A1 Aug. 8, 2013

(51) Int. Cl.
*B65D 81/00* (2006.01)
*B65D 81/38* (2006.01)

(52) U.S. Cl.
CPC ..... *B65D 81/389* (2013.01)

(58) Field of Classification Search
CPC ..... B65D 81/38; B65D 25/28; B65D 81/389; B65D 81/3893
USPC ..... 220/592.18, 592.2, 23.9, 495.03, 495.05; 62/457.1, 457.7, 457.9
See application file for complete search history.

(56) References Cited

U.S. PATENT DOCUMENTS 2,845,973 A * 8/1958 Strong ..... A45C 3/06 150/101
D243,637 S * 3/1977 Rabinowitz ..... D3/289
4,311,022 A * 1/1982 Hall ..... A45C 11/20 62/372
4,528,439 A * 7/1985 Marney et al. ..... 219/386
4,598,746 A * 7/1986 Rabinowitz ..... A45C 3/00 206/545
5,090,526 A * 2/1992 Jacober ..... A45C 3/00 190/107
5,216,900 A * 6/1993 Jones ..... A45C 11/20 224/148.3
5,570,588 A * 11/1996 Lowe ..... B65D 81/3818 62/457.7
5,934,099 A * 8/1999 Cook et al. ..... 62/457.2
5,975,336 A * 11/1999 Hart ..... B65D 81/18 220/592.16
6,116,045 A * 9/2000 Hodosh ..... A45C 11/20 62/457.4
6,244,458 B1 * 6/2001 Frysinger et al. ..... 220/592.09
6,296,138 B1 * 10/2001 Hannah et al. ..... 220/495.08
6,412,545 B1 * 7/2002 Buff et al. ..... 165/10
6,446,461 B1 * 9/2002 Williams, Jr. ..... A45C 11/20 220/592.16
6,688,470 B2 * 2/2004 Dege et al. ..... 206/545
6,789,693 B2 * 9/2004 Lassiter ..... 220/592.18
7,043,935 B2 * 5/2006 Hunter ..... 62/457.2
7,299,652 B2 * 11/2007 Gagnon ..... 62/457.2
7,334,684 B1 * 2/2008 Fontanilla ..... A45C 11/20 190/110
7,500,593 B2 * 3/2009 Mayer ..... 229/103.11
(Continued)

*Primary Examiner* — Ernesto A Grano
(74) *Attorney, Agent, or Firm* — Spradley PLLC; Michael Spradley

(57) ABSTRACT

A system for maintaining a temperature within a cooler is disclosed. In one embodiment, the cooler can include an outer shell comprising an insulating material. The cooler can also include a temperature retention insert resting inside the outer shell. In another embodiment, the cooler can include an outer shell and an isolation chamber with one or more vertical support strips. In another embodiment, a cooler can comprise an outer shell with multiple grooves in the inner wall of the outer shell wherein the grooves can secure one or more temperature retention blocks.

13 Claims, 8 Drawing Sheets

(56) References Cited

U.S. PATENT DOCUMENTS

| | | | | |
|---|---|---|---|---|
| 8,209,995 | B2 * | 7/2012 | Kieling | A45C 3/001 62/457.1 |
| 8,215,515 | B2 * | 7/2012 | Churchill | 220/560 |
| 8,348,087 | B2 * | 1/2013 | Sawaki | 220/592.2 |
| 8,348,510 | B2 * | 1/2013 | Mogil | A45C 5/02 383/105 |
| 9,462,874 | B1 * | 10/2016 | Samuel | A45C 13/02 |
| 2003/0010780 | A1 * | 1/2003 | Redzisz | A45C 7/0077 220/6 |
| 2005/0051404 | A1 * | 3/2005 | Chi | 190/107 |
| 2005/0056048 | A1 * | 3/2005 | Fuchs | A45C 11/20 62/457.7 |
| 2006/0027293 | A1 * | 2/2006 | Willems | A45C 3/06 150/112 |
| 2008/0099492 | A1 * | 5/2008 | Mayer | 220/592.2 |
| 2008/0178629 | A1 * | 7/2008 | Meether | 62/451 |
| 2008/0257896 | A1 * | 10/2008 | Guy et al. | 220/592.2 |
| 2009/0294455 | A1 * | 12/2009 | Pruchnicki | 220/592.2 |
| 2011/0031254 | A1 * | 2/2011 | Mortarotti | 220/592.2 |
| 2012/0091147 | A1 * | 4/2012 | LaMere et al. | 220/592.2 |
| 2012/0321226 | A1 * | 12/2012 | Hansen | A45C 13/02 383/104 |

* cited by examiner

SYSTEM AND METHOD FOR MAINTAINING A TEMPERATURE WITHIN A COOLER

BACKGROUND

This disclosure relates to a system for maintaining a temperature within a cooler.

Many people use a cooler filled with ice to keep beverages and food cold in warm weather. Coolers, however, do not provide enough insulation to keep out all the exterior heat, and the interior temperature rises. Slowly, the ice inside the cooler starts melting into water. Consequently, the contents of the cooler can become wet and soggy when contacted by water, potentially ruining them.

As such it would be advantageous to have an improved system for maintaining a temperature within a cooler.

SUMMARY

A system for maintaining a temperature within a cooler is disclosed. In one embodiment, the cooler can include an outer shell comprising an insulating material, with the outer shell comprising one or more shell walls forming an enclosed loop, a lid, and a base. The cooler can also include a temperature retention insert resting inside the outer shell, with the temperature retention insert comprising a plurality of insert walls together having a shape substantially similar to the outer shell, wherein each of the insert walls comprise a temperature retention material enclosed in an inner barrier wall and an outer barrier wall, with the outer barrier wall touching the inside shell wall of the outer shell. The temperature retention insert can be attached to the outer shell by a first fastener connected to the outer shell and a second fastener connected to the temperature retention insert, with the first fastener being mateable with the second fastener.

In another embodiment, the cooler can include an outer shell comprising an insulating material, with the outer shell comprising one or more shell walls forming an enclosed loop, a lid, and a base. The cooler can include an isolation chamber comprising one or more chamber walls and one or more vertical support strips placed intermittently along an outer edge of the four chamber walls, a first side of each of the vertical support strips connected to one of the chamber walls. A second side of the vertical support strips can contact an inside portion of one of the shell walls, wherein the vertical support strips, the shell walls, and the chamber walls can form one or more chambers capable of housing one or more temperature retention blocks.

In another embodiment, a cooler can comprise an outer shell comprising an insulating material, with the outer shell comprising one or more shell walls forming an enclosed loop, a lid, and a base, with multiple grooves in the inner wall of the outer shell wherein the grooves can secure one or more temperature retention blocks. The cooler also includes one or more temperature retention blocks wherein the temperature retention blocks are inserted into grooves in the outer shell, and further wherein, the temperature retention block is a housing for the temperature retention material.

DETAILED DESCRIPTION

Described herein is a system for maintaining a temperature within a cooler. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
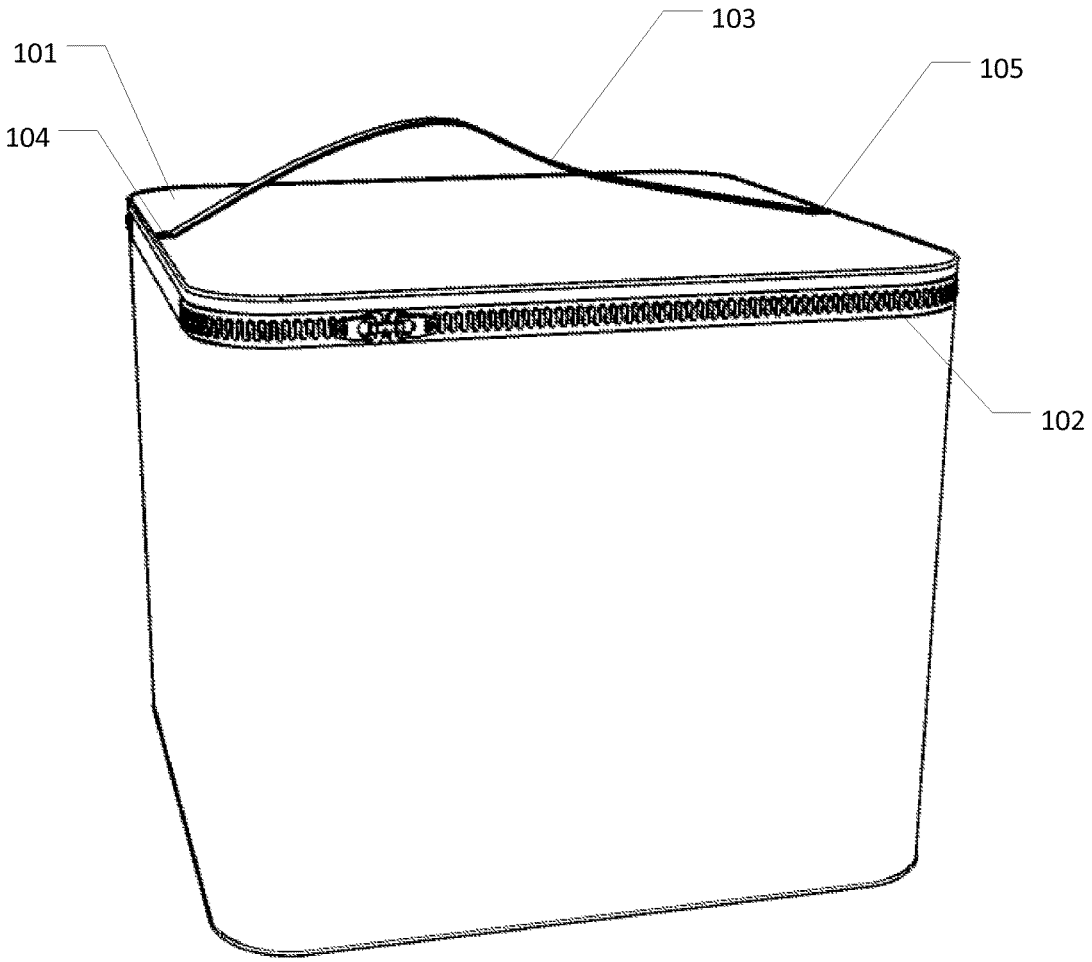
FIG. 1 illustrates one embodiment of a cooler in a closed position.

FIG. 1 illustrates one embodiment of a cooler 100 in a closed position. Cooler 100 can be made of various materials such as plastic, rubber, neoprene, metal, etc., and can comprise a top cover 101 attached to the rear of cooler 100. The top cover 101 can be sealed using a zipper 102, or a latch or any other device known in the art. Additionally, top cover 101 seal can further comprise a gasket preventing cold air from leaking outside and preventing hot air from getting inside of cooler 100. Cooler 100 can further comprise a handle 103 attached to top cover 101 or sides of cooler 100 at a first section 104 and a second section 105. Also, cooler 100 can further comprise different compartments, as discussed below.

Figure 2A:
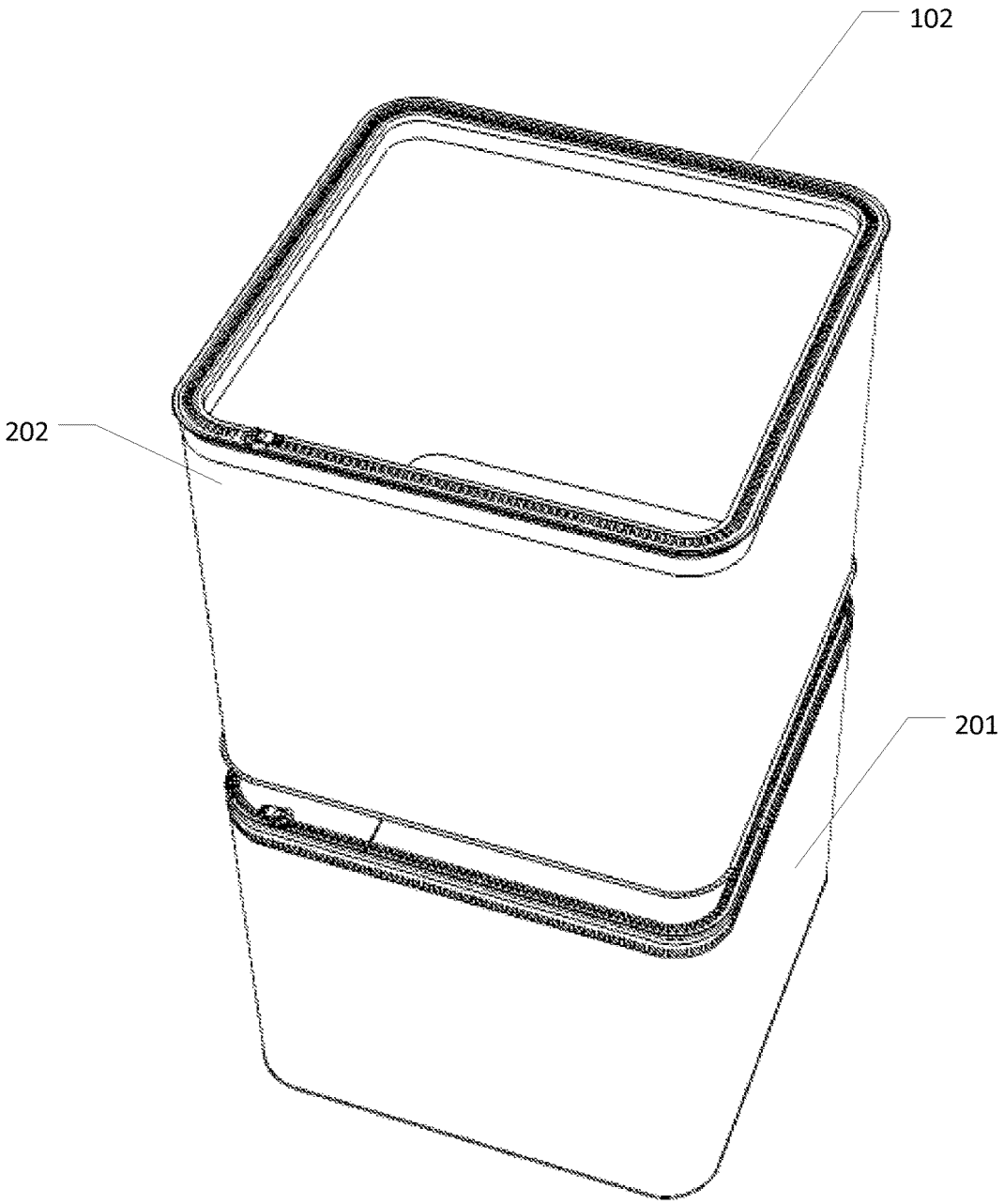
FIG. 2A illustrates an exploded view of cooler comprising an outer shell and a temperature retention insert.
Figure 2B:
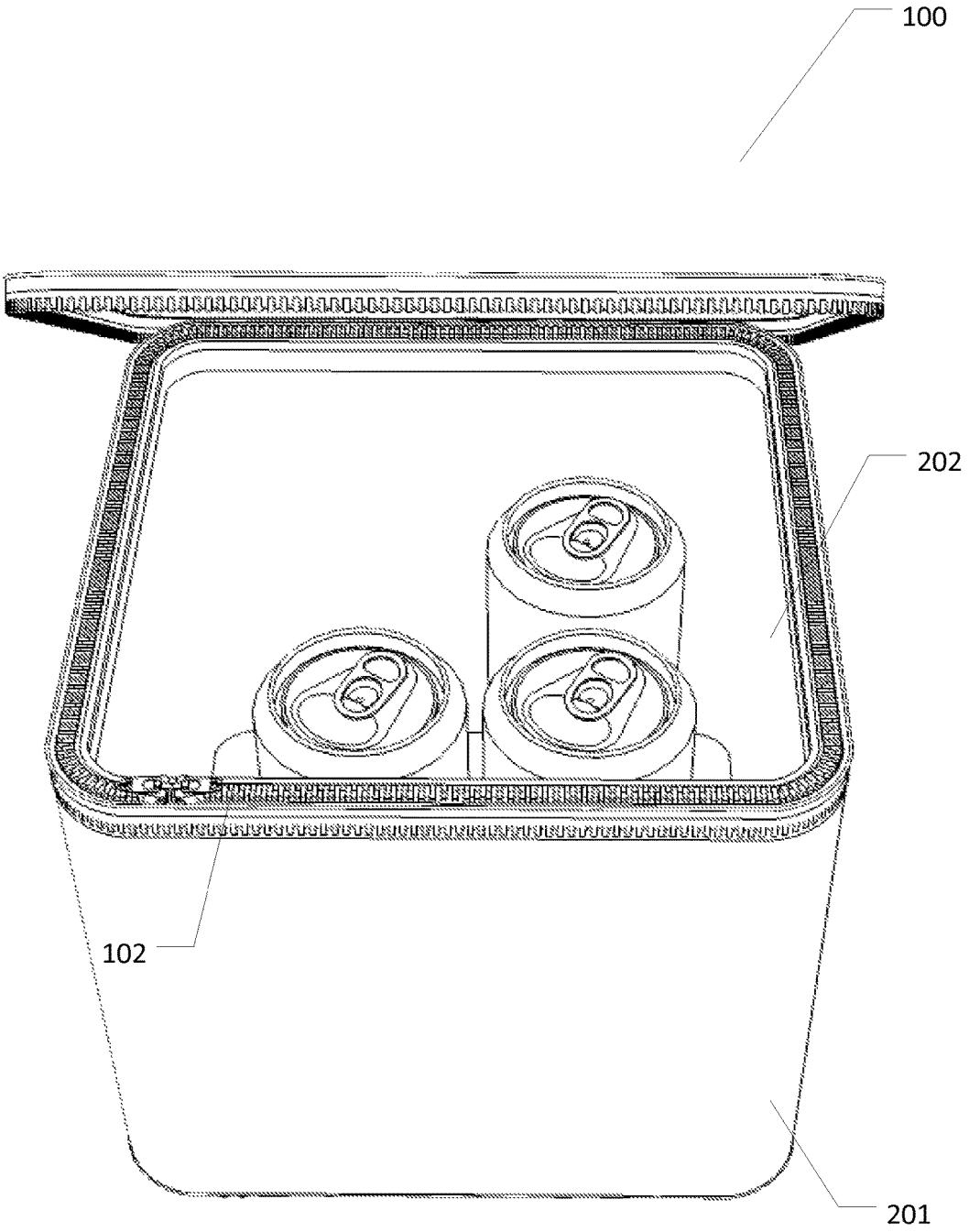
FIG. 2B illustrates cooler in an open position with temperature retention insert embedded in outer shell.

FIG. 2A illustrates an exploded view of cooler 100 comprising an outer shell 201 and a temperature retention insert 202. FIG. 2B illustrates cooler 100 in an opened position with temperature retention insert 202 embedded in outer shell 201. Temperature retention insert 202 can be slightly smaller than outer shell 201. Then, temperature retention insert 202 can embed in and pull out from outer shell 201. In one embodiment, temperature retention insert 202 can also comprise one or more fasteners to secure temperature retention insert within outer shell 201. In such an embodiment, zipper 102 can comprise a first zip 102*a* placed onto the walls of outer shell 201 and a second zip 102*b* attached to top of the walls of temperature retention insert 202. In a sealed position, zipper 102 can securely attach temperature retention insert 202 into outer shell 201, as shown in FIG. 2B. In an open position, a user can pull out temperature retention insert 202 from outer shell 201. Temperature retention insert 202 can be placed in a cold environment such as a refrigerator and then placed back inside outer shell 201. Further, in such embodiment, temperature retention insert 202 can be made of flexible material such as polychloroprene, aluminum, and/or flexible synthetic rubber. In such embodiment, temperature retention insert 202 can be collapsible for storage or to fit easily in a refrigerator. Outer shell 201 can comprise an insulating material. Outer shell 201 can also prevent temperature retention insert 202 from quickly reverting to room temperature as heat can transfer to temperature retention insert 202.

Figure 3:
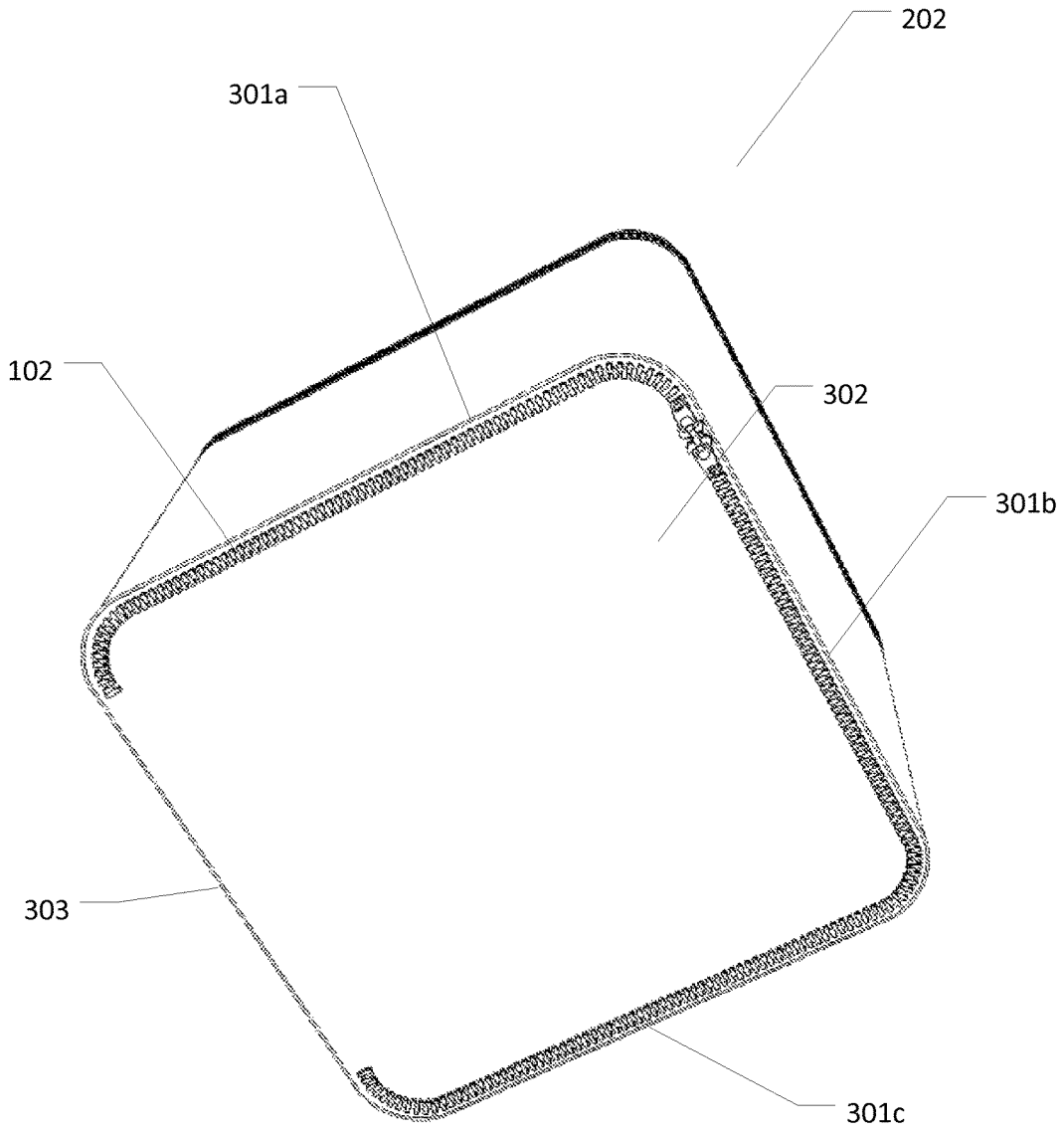
FIG. 3 illustrates a bottom view of temperature retention insert comprising a zipper connecting shell base to the walls of the shell.

FIG. 3 illustrates a bottom view of temperature retention insert 202 comprising a base zipper 102. In an embodiment wherein temperature retention insert 202 comprises a flexible material, temperature retention insert 202 can be made to be collapsible; a first zip of second zipper 102 can be substantially attached to wall 301*a*, 301*b*, and 301*c* of temperature retention insert 202. A second zip of base zipper 102 can be attached to a portion of the bottom 302 of temperature retention insert 202. Temperature retention insert 202 can further comprise a hinge section 303 that is placed at one side of a bottom 302. In an opened position, bottom 302 can be folded up at hinge section 303, and a user can collapse temperature retention insert 202 for easy storage in a refrigerator or other place when not in use. In a fully closed position, bottom 302 can be sealed with base zipper 102, as shown in FIG. 3.

Figure 4:
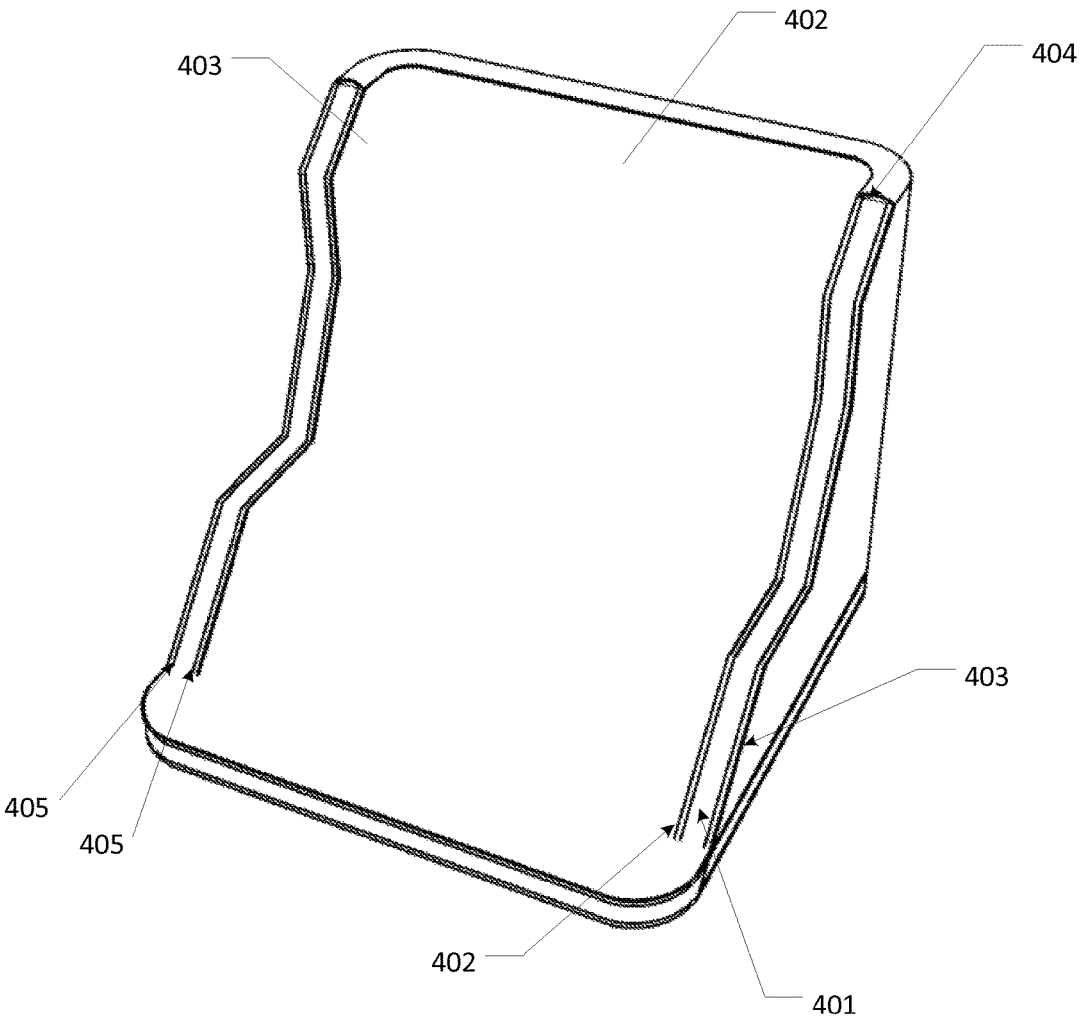
FIG. 4 illustrates a cutaway view of temperature retention insert.

FIG. 4 illustrates a cutaway view of temperature retention insert 202. Temperature retention insert 202 can comprise a temperature retention material 401 encased in an inner barrier wall 402 and an outer barrier wall 403. Temperature retention material 401 can be liquid, solid or gel. Barrier walls 402 and 403 define the shape of temperature retention insert 202. Barrier walls 402 and 403 should be in a preferred embodiment, impermeable to prevent contents of temperature retention insert 202 from harming food items in cooler 100. Further, in one embodiment, temperature retention insert 202 can comprise an insulating gasket 404 placed above the top 405 of barrier walls 402 and 403. In one embodiment, outer barrier wall 403 can act as an insulating layer. In such embodiment, cooler 100 may not comprise a separate outer shell. Further, in such embodiment, temporary retention insert 202 can include insulating materials 405 that can resist the flow of heat from ambient temperature and prevent cold loss. As such, barrier wall 403 can keep temperature retention insert 202 as cool as possible. Examples of an insulating material can be but not limited to, fiber glass, rubber, Styrofoam, polychloroprene, and/or plastic.

Figure 5:
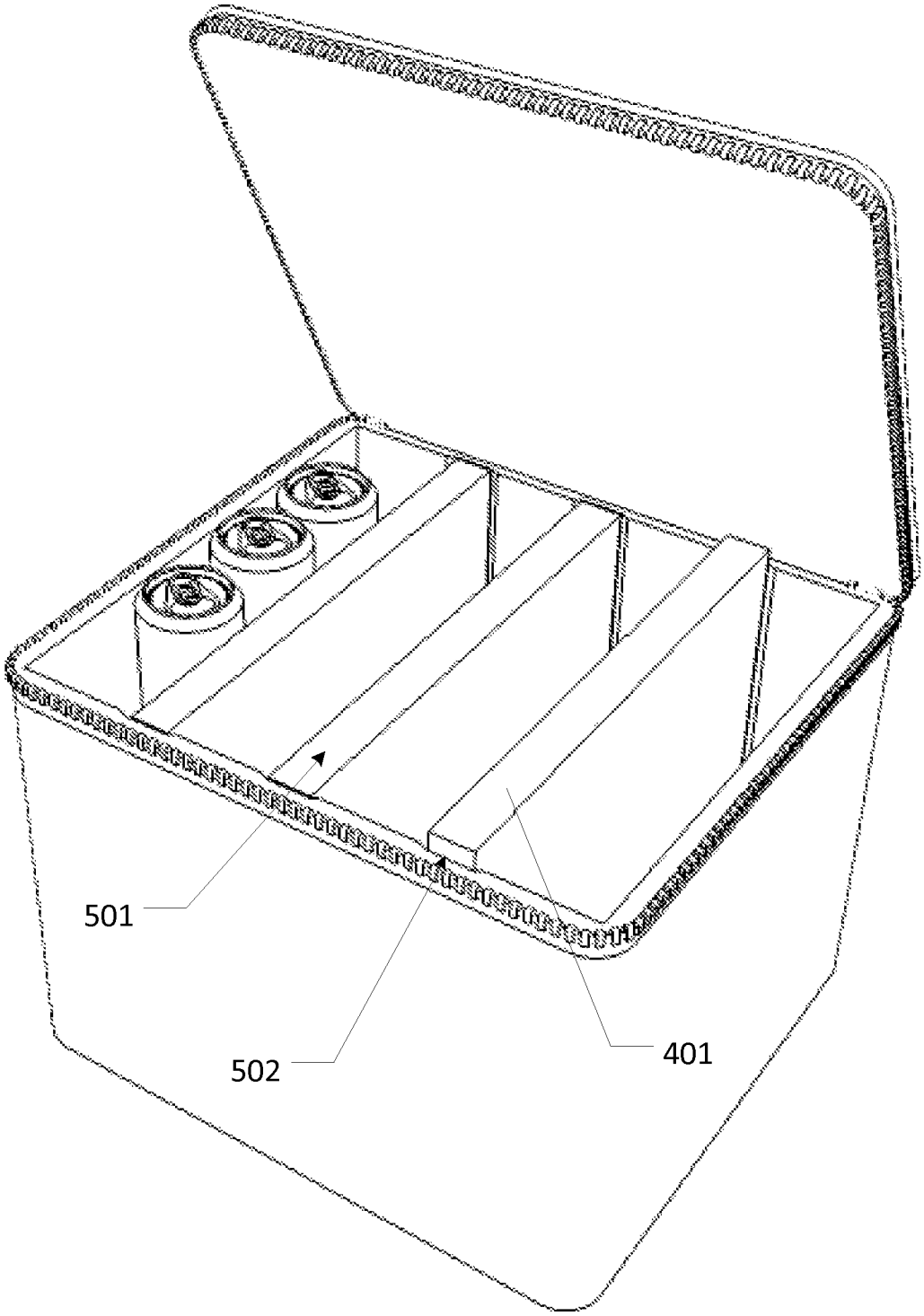
FIG. 5 illustrates another embodiment of cooler comprising temperature retention block.

FIG. 5 illustrates another embodiment of cooler 100 comprising one or more temperature retention blocks 501. In such embodiment, temperature retention block 501 comprises a hard outer shell filled with temperature retention material 401. Temperature retention block 501 can also act as a container for temperature retention material 401. Furthermore, cooler 100 can also comprise a one or more slot-in grooves 502 for securing temperature retention block 501 in place, as shown in FIG. 5. Temperature retention block 501 can be made using any insulating materials known in the art. Temperature retention block can section off cooler 100, while keeping cool areas next to food items.

Figure 6A:
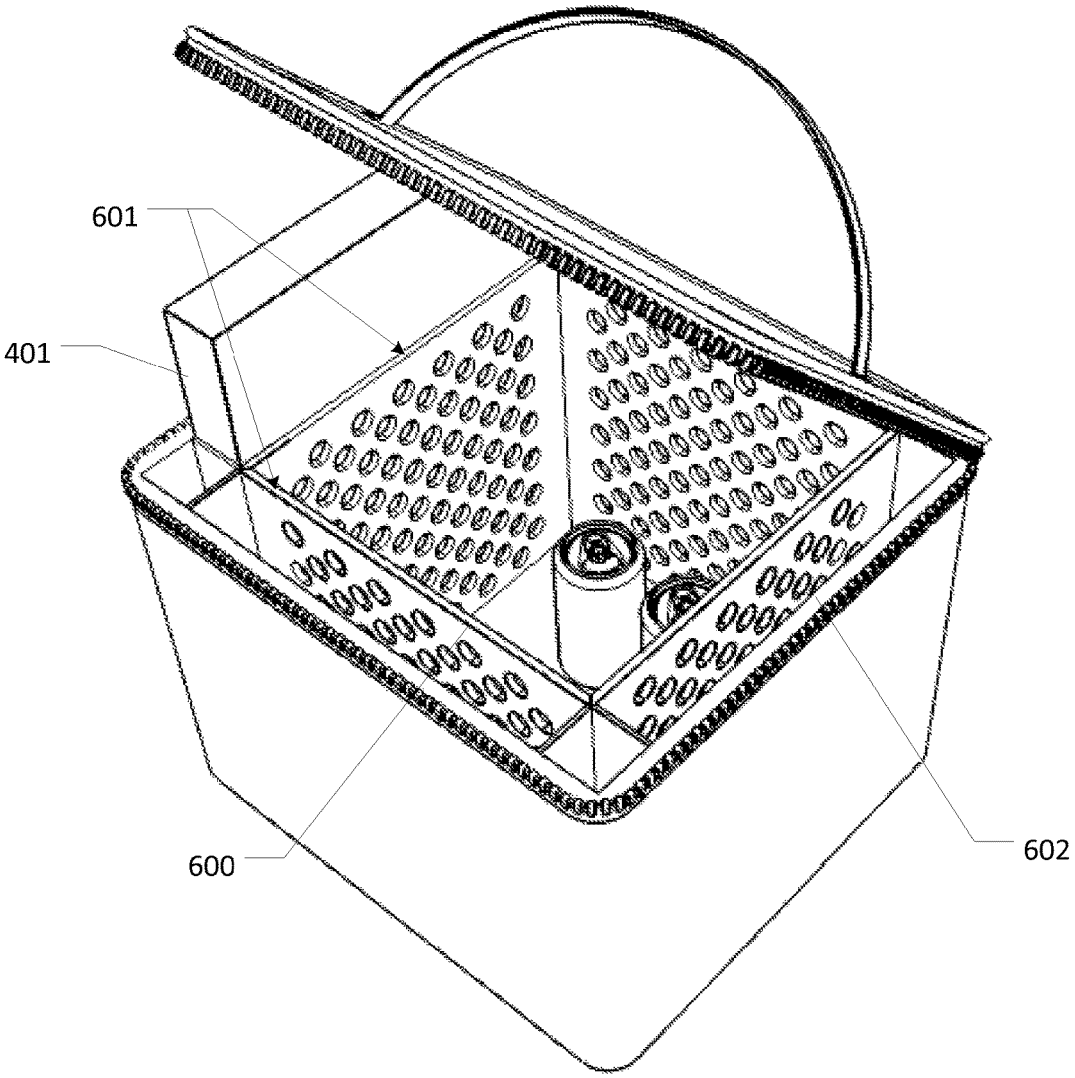
FIG. 6A illustrates a vented isolation chamber within cooler.
Figure 6B:
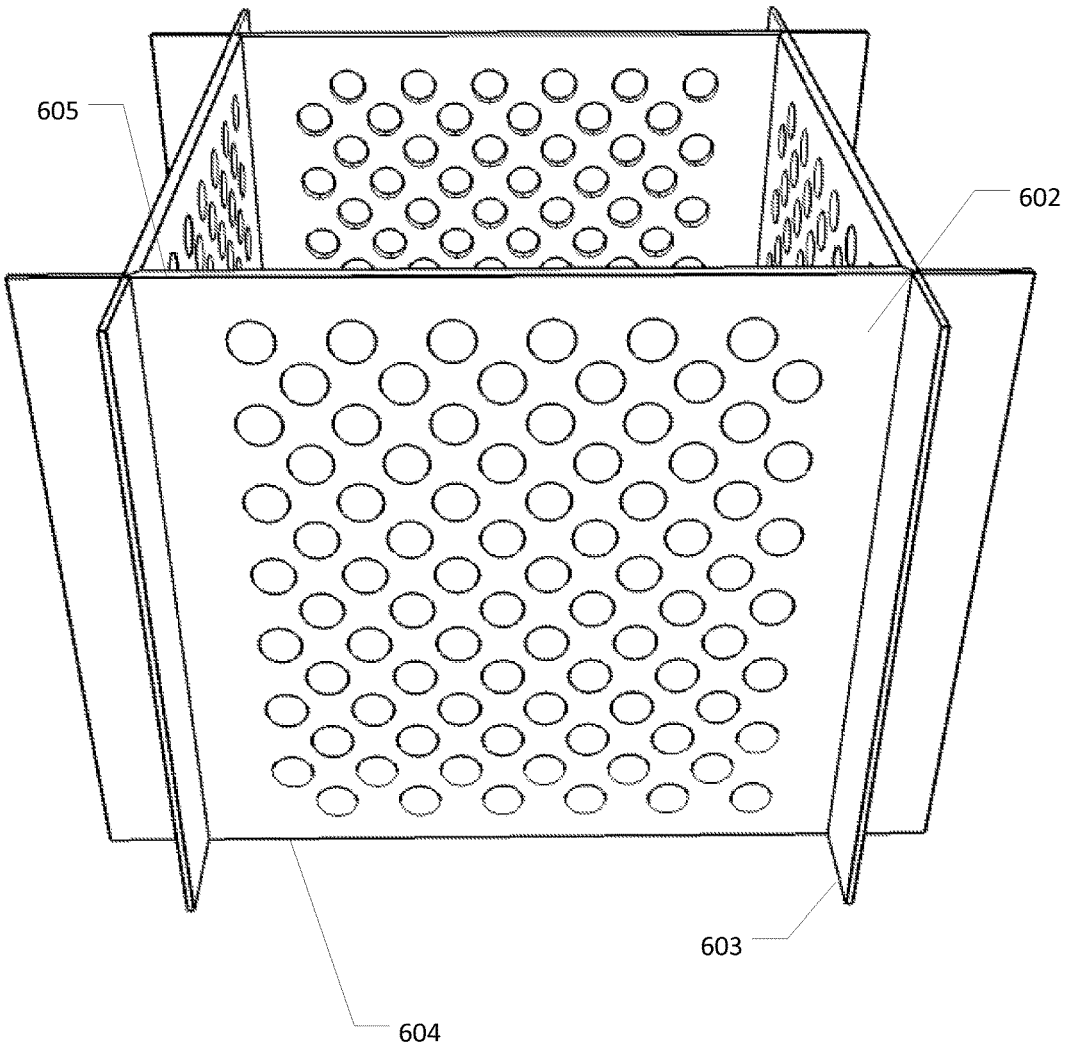
FIG. 6B illustrates vented isolation chamber comprising of multiple vertical strips.

FIG. 6A illustrates a vented isolation chamber 600 within cooler 100. FIG. 6B illustrates vented isolation chamber 600 comprising multiple vertical support strips 601 circumscribing vented isolation chamber 600. Vented isolation chamber 600 can be either separate, removable component, or an integral component of cooler 100. In one embodiment wherein vented isolation chamber 600 is a separate component, vented isolation chamber 600 can comprise one or more vertical support strips 601 that can be placed within cooler 100, as shown in FIG. 6B. In another embodiment, vertical support strips 601 can be an integral portion of cooler 100. Vertical support strips 601 can form a housing recess 602 for receiving temperature retention block 501. In one embodiment wherein vented isolation chamber 600 is an integral component, vented isolation chamber 600 can comprise multiple extrusions 603 from bottom 604 of vented isolation chamber 600 extended to the top 605 of vertical support strips 601.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A cooler comprising an outer shell comprising an insulating material, said outer shell comprising a plurality of shell walls forming an enclosed loop, a lid, and a base said base permanently attached to only one of said shell walls; and a temperature retention insert resting inside said outer shell, said temperature retention insert comprising a plurality of insert walls and a base, said insert walls and said base connected together to form a single structure substantially similar to said outer shell, wherein said insert walls comprise a temperature retention material enclosed between an inner barrier wall and an outer barrier wall, said inner barrier wall substantially parallel with said outer barrier wall, further said outer barrier wall forming substantially all of an outer surface of said insert walls, and said inner barrier wall forming substantially all of said inner surface of said inner walls, said temperature retention material continuously and substantially filling a space between said inner barrier wall and said outer barrier wall, said outer barrier wall touching an inside shell wall of said outer shell.

2. The cooler of claim 1 wherein said temperature retention insert is removable.

3. The cooler of claim 1, a first fastener connected to said outer shell; and a second fastener connected to said temperature retention insert, further wherein said first fastener is mateable with said second fastener.

4. The cooler of claim 3 wherein said first fastener is a first zip and said second fastener is a second zip wherein said first and second fastener come together to form a zipper.

5. The cooler of claim 1 wherein said insulating material is neoprene.

6. The cooler of claim 1 wherein said insulating material is rubber.

7. The cooler of claim 1 wherein said insulating material is Styrofoam.

8. The cooler of claim 1 wherein said insulating material is plastic.

9. The cooler of claim 1 wherein said insulating material is polychloroprene.

10. The cooler of claim 1 wherein said temperature retention material is solid.

11. The cooler of claim 1 wherein said temperature retention material is liquid.

12. The cooler of claim 1 wherein said temperature retention material is gel.

13. The cooler of claim 1 comprising a second temperature retention material within said base.

* * * * *